United States Patent [19]

Kooy et al.

[11] Patent Number: 4,995,234

[45] Date of Patent: Feb. 26, 1991

[54] POWER GENERATION FROM LNG

[75] Inventors: Richard J. Kooy, Western Springs; John S. Andrepont; Roger F. Gyger, both of Naperville, all of Ill.; Lewis Tyree, Jr., Lexington, Va.

[73] Assignee: Chicago Bridge & Iron Technical Services Company, Plainfield, Ill.

[21] Appl. No.: 415,649

[22] Filed: Oct. 2, 1989

[51] Int. Cl.[5] ..... F01K 25/10

[52] U.S. Cl. ..... 60/648; 60/652; 60/659; 60/655; 60/651

[58] Field of Search ..... 60/648, 652, 659, 655, 60/651, 671

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,154,928 | 11/1964 | Harmens | 62/53 |
| 3,183,666 | 5/1965 | Jackson | 60/38 |
| 3,503,207 | 3/1970 | Strub | 60/36 |
| 3,579,982 | 5/1971 | Strub | 60/36 |
| 3,628,332 | 12/1971 | Kelmar | 60/105 |
| 3,878,683 | 4/1975 | Imai | 60/647 |
| 3,971,211 | 7/1976 | Wethe et al. | 60/39.18 R |
| 4,330,998 | 5/1982 | Nozawa | 60/655 |
| 4,437,312 | 3/1984 | Newton et al. | 60/648 |
| 4,765,143 | 8/1988 | Crawford et al. | 60/671 |

OTHER PUBLICATIONS

Maertens, J., "Design of Rankine Cycles for Power Generation from Evaporating LNG," *Rev. Int. Froid*, 9: 137–143 (1986).

Andrepont, J. S., et al., "SECO$_2$ (Stored Energy in $CO_2$): Retrofit $CO_2$ Bottoming Cycles with Off-Peak Energy Storage for Existing Combustion Turbines," presented at Ann. Meet of American Power Conference, Chicago, Ill., Apr. 20, 1988, spon. by Illinois Institute of Technology.

*Primary Examiner*—Allen M. Ostrager

*Attorney, Agent, or Firm*—Fitch, Even, Tabin & Flannery

[57] ABSTRACT

LNG is pumped to high pressure, vaporized, further heated and then expanded to create rotary power that is used to generate electrical power. A reservoir of carbon dioxide at about its triple point is created in an insulated vessel to store energy in the form of refrigeration recovered from the evaporated LNG. During peak electrical power periods, liquid carbon dioxide is withdrawn therefrom, pumped to a high pressure, vaporized, further heated, and expanded to create rotary power which generates additional electrical power. The exhaust from a fuel-fired combustion turbine, connected to an electrical power generator, heats the high pressure carbon dioxide vapor. The discharge stream from the $CO_2$ expander is cooled and at least partially returned to the vessel where vapor condenses by melting stored solid carbon dioxide. During off-peak periods, $CO_2$ vapor is withdrawn from the reservoir and condensed to liquid by vaporizing LNG, so that use is always efficiently made of the available refrigeration from the vaporizing LNG, and valuable peak electrical power is available when needed by using the stored energy in the $CO_2$ reservoir.

19 Claims, 2 Drawing Sheets

POWER GENERATION FROM LNG

The present invention relates to a plant for generating power, particularly electrical power, from LNG, and more particularly to a plant utilizing LNG which can be economically operated to generate a highly variable amount of electrical power as a result of including a large reservoir of $CO_2$ at the triple point thereof and also employing $CO_2$ as a working fluid to generate power by the expansion thereof.

BACKGROUND OF THE INVENTION

LNG (liquefied natural gas) has become a particularly important energy source in a number of countries such as Japan, Korea, Taiwan, and various countries of Europe which are dependent upon outside energy sources, and many areas of the world depend on LNG as their primary source for natural gas. Natural gas is routinely liquefied in Saudia Arabia and Indonesia (by lowering its temperature to about −260° F), thus increasing its density about 600 times. It is then shipped in special insulated tankers to Europe and the Far East, particularly Japan, where it is stored in insulated tanks until required. When gas is required, the LNG pressure is increased by pumps until it matches the pipeline pressure and then it is vaporized. This step requires a large addition of heat to the LNG before it can be added to the natural gas distribution pipeline network on an "as needed" basis. Such pipeline networks can be operated at quite varied pressures. For natural gas that is to be utilized in the immediate vicinity, a pressure of less than 50 psig is frequently used. For more distant supply areas, pressures of about 250 psig are frequently utilized. In some cases, longer distance high pressure distribution lines may utilize pressures of 500 psig and even higher.

Since LNG terminals at the receiving points are nearly always located near water to accommodate ocean-going tankers, sea water is usually available to provide the necessary heat of vaporization. It has long been recognized that the refrigeration potential of such vast quantities of LNG is considerable, and it has been a real challenge to attempt to economically use the cold energy that is available. Recently however, the refrigeration potential of LNG has received increasing attention. This situation is described by J. Maertens in his article entitled, "A Design of Rankine Cycles for Power Generation from Evaporating LNG" which appeared in *Rev. Int. Froid.* 1986, Vol. 9, pp. 137–143. Maertens indicated that, in addition to the generation of electrical energy, there have been efforts made to use the LNG cold potential, in Japan, to produce solid $CO_2$ (dry ice) at −110° F, to cool entering air for an air separation plant which may operate at about −320° F., or to refrigerate cold storage food warehouses at about −20° F.

The generation of electrical power has been one of the more frequently investigated uses of the cold energy potential of LNG. U.S. Pat. No. 2,975,607 shows the recovery of power during the vaporization of LNG by a single expansion of a condensable circulating refrigerant, such as propane or ethane, and suggests the use of sea water to provide an ambient heat source. The use of a cascade refrigeration system employing ethane and then propane for vaporizing LNG streams and recovering power by the use of expanders is shown in U.S. Pat. No. 3,068,659. U.S. Pat. No. 3,183,666 uses a gas turbine which burns methane to vaporize the working fluid, i.e. ethane, before it is expanded and then condensed against the vaporizing LNG. More recent U.S. Pat. No. 4,330,998 discusses the potential problems that can occur from the use of sea water in a confined area from the standpoint of "cold water pollution". This patent proposes to use a circulating freon stream which can be expanded to drive a turbine, to create mechanical energy and ultimately generate electricity. This patent specifically discloses the use of LNG to condense nitrogen, which is subsequently expanded to create power after being pumped to high pressure and vaporized by condensing freon which is used as the working fluid in a main power plant. U.S. Pat. No. 4,437,312 discloses the vaporization of LNG through a series of heat exchangers in which it absorbs heat from two different multicomponent streams of gases, with one stream containing four hydrocarbons and some nitrogen while the other stream contains a three hydrocarbon mixture. Both streams are expanded in turbines to create electrical power. The Maertens paper also discusses various power cycles for using the LNG in electrical power generation.

All of the previously directed uses of LNG refrigeration have certain drawbacks. These refrigeration use cycles often experience the following disadvantages: the inefficient use of the low temperature potential (e.g., using −240° F. LNG which vaporizes at 50 psig to cool $CO_2$ to dry ice temperatures of −110° F); the quantities of heat don't match, i.e., the small quantity of air separation products produced and sold in liquefied form compared to the much larger amount of LNG which must be vaporized; the liquefication temperatures don't specifically match, causing the use of temperature-lowering devices; and/or the use cycle of natural gas from a time standpoint doesn't match the use cycle of the partner process.

The electric power generating cycles discussed by Maertens attempt to rectify such drawbacks by using the refrigeration potential of the LNG in combination with certain complex intermediate working fluid cycles. However, the Maertens cycles are both complex and expensive. They must be sized to handle varying LNG flows, which makes them either expensively over-sized for much of the time or, if undersized for the peaks, wasteful of much of the refrigeration.

All of the aforementioned power cycles suffer from another defect: namely, they make electricity only when natural gas is being used. Therefore, they are not weighted towards the "peak hours" of electrical demand, when electricity has a much higher value.

Electric utility companies, whatever their source of energy, have recently endeavored to make better use of their base load power plants and have considered storing electrical power. They have also investigated the employment of highly efficient power generation systems to meet peak load demands. One highly efficient way of electrical power generation is to employ a gas or oil-fired combustion turbine as a part of a combined-cycle system. In such a system, the heat rejected by the higher temperature or topping cycle is used to drive the lower temperature cycle to produce additional power and operate at a higher overall efficiency than either cycle could achieve by itself. The lower temperature cycle is referred to as the "bottoming cycle", and typically most bottoming cycles have been steam-based Rankine cycles, which operate on the heat rejected, for example by a combustion turbine exhaust. This peak consideration led Crawford et al., in U.S Pat. No.

4,765,143, to propose a power plant using a main turbine to drive a generator with the use of carbon dioxide as the working fluid in a bottoming cycle. This system has the ability to generate a large amount of electrical power during periods of peak usage throughout the week while storing excess power that is available during non-peak hours. This patent also suggests the possible use of LNG to provide the refrigeration to the $CO_2$ power cycle.

A paper entitled "$SECO_2$ (Stored Energy in $CO_2$) Retrofit $CO_2$ Bottoming Cycles with Off-Peak Energy Storage for Existing Combustion Turbines," by J. S. Andrepont et al. studied the cost and performance of combined cycle gas turbines with such a $CO_2$ power cycle for peaking service under various conditions; the required mechanical refrigeration equipment was very expensive to install and operate. While the LNG-$SECO_2$ combination suggested in the above patent broadly contemplated another potential use of LNG's refrigeration, it made no attempt to efficiently take advantage of LNG's very low temperature potential, because the $CO_2$ triple point occurs near −70° F and only a limited temperature difference is required for heat transfer. While the varying LNG vaporization demand might indicate that high temperature differences across the heat exchanger be employed to minimize equipment cost, the use of a 30° F temperature approach requires a low temperature of only −100° F. Therefore, the ample available refrigeration of LNG below −100° F would not be well utilized with a direct heat exchanger configuration.

Few of the existing systems designed to utilize the available LNG refrigeration appear to have true commercial potential. Low temperature uses of LNG are often at inconvenient levels or not well matched to utilize the cold potential without any limitation upon LNG's primary role, which is to supply natural gas to a distribution network at a variety of pressures and appropriate temperatures. Therefore, although these various systems may have certain advantages in particular situations, the electrical power-generating industry and the natural gas pipeline industry have continued to search for more efficient and economical systems.

SUMMARY OF THE INVENTION

The present invention both utilizes LNG's low temperature refrigeration potential (below −100° F) and utilizes LNG as a refrigeration source for $CO_2$, particularly advantageously in connection with a $CO_2$ power cycle, employing a mechanically simple system which would not restrict the various natural gas flows required. Complex intermediate cycles, such as Maertens suggested, were investigated but have not been preferred. Solving this problem in an economical fashion required a thorough understanding of the entropy relationships of these various operations and results in a significant improvement to the existing state of the art, with great commercial significance. This results in part from the fact that the $CO_2$ power cycle exhibits characteristics which should make it an admirable energy partner to an LNG vaporizing cycle; for example, of the total of about 370 BTUs per pound required to convert LNG stored at atmospheric pressure to natural gas at about 50 psig and +40° F, about 300 BTUs per pound are usable to condense $CO_2$ and then to produce electrical power thereafter as needed.

It has been found that LNG can be vaporized as part of a direct expansion natural gas power cycle, arranged so that the bulk of its vaporization refrigeration is not much warmer than the −100° F required by a $CO_2$ power cycle, wherein the vaporizing LNG is used in converting triple point $CO_2$ to solid. If the LNG is pumped to a higher pressure than the intended distribution pressure which may be about 50, 250 or 500 psia, then vaporized by heat exchange to a $CO_2$ power cycle slush chamber, and then further warmed to ambient by sea water or other medium (or even heated), it has been found that the natural gas can be efficiently expanded in a power generation system to about the desired distribution pressure, re-warmed and fed to the distribution network. By this method, the best use is made of the LNG refrigeration potential, both from the standpoint of utilizing its refrigeration value and of utilizing its low temperature potential.

A system is provided which is a mechanically simple, efficient cycle and which improves upon the $CO_2$ power cycle and upon previous uses of LNG. Part of the LNG refrigeration energy potential is utilized to create electricity at the same time as the LNG is vaporized. The majority of the refrigeration potential is stored in $CO_2$ slush, to be used later as needed in a $CO_2$ Power Cycle, to generate electricity when it is most valuable, during peak demand periods Thus, in essence, the power expended in Saudia Arabia or Indonesia to create the LNG is largely returned, but at a final use point where such energy has a high value. When a large part of the energy is used to generate peak electrical power having a still higher value, even further advantage is derived.

It has been found that surprisingly high efficiencies can be achieved in the generation of power from LNG in combination with the use of carbon dioxide as a working fluid in an overall power-generating system which includes a large reservoir wherein the carbon dioxide is stored at its triple point. The thermodynamic characteristics of carbon dioxide are such that it may be uniquely suited to efficiently utilize the available LNG refrigeration potential. This combined system can economically and efficiently produce a fairly high base load of electrical power which is matched to the pipeline demand for natural gas. In addition, the system is fully capable of producing far larger amounts of electrical power during the peak demand period of the day when electrical power usage is highest. Moreover, should it be anticipated that electrical power demand might occasionally be less than the base load during off-peak periods, while the natural gas pipeline requirements remain steady, then this excess electricity generated from the LNG vaporization could be partially utilized to further "recharge" the reservoir during those periods by operating an ancillary mechanical refrigeration unit that is provided, as taught in U.S. Pat. No. 4,765,143, the disclosure of which is incorporated herein by reference.

The $CO_2$ portion of the overall system is, in effect, a closed cycle heat engine operation of the Rankine type with a depressed rejection temperature which uses carbon dioxide as its working fluid and which incorporates thermal storage capability. A variety of sources of heat can be utilized, even relatively low level heat from other higher level cycles, for example the exhaust from a combustion turbine. Other sources of heat, such as coal-fired combustors and direct-fired gas or oil combustors, can also be used. The overall system is based upon efficiently utilizing the large amounts of refrigeration available in liquefied natural gas (LNG) which is being vaporized to allow natural gas to be fed into a gas pipeline distribution system. Thus, the heat source is preferably one that is available during peak demand periods.

More specifically, the invention in another aspect provides a system uniquely suited for economically and efficiently generating electrical power from LNG which is being vaporized to meet pipeline needs, which system is designed to produce a base load of electrical power that may vary somewhat depending upon restrictions in the demand for pipeline natural gas. However, the overall system vaporizes LNG by directly or indirectly condensing $CO_2$ vapor, or by possibly solidifying liquid $CO_2$ at the triple point, while during peak periods $CO_2$ vapor is being continuously generated as a result of $CO_2$ being used as a working fluid in a Rankine cycle. The system includes an insulated vessel for storing liquid carbon dioxide at its triple point, and during off-peak demand periods, the refrigeration available in the very cold LNG is used for creating a reservoir containing a substantial amount of solid carbon dioxide in carbon dioxide liquid at about its triple point. During periods of peak demand, liquid carbon dioxide is withdrawn from the vessel, very substantially increased in pressure and then heated as a part of a Rankine cycle and vaporized. By expanding the carbon dioxide vapor through an expander, such as a turbine, to dry vapor, or to vapor containing some entrained liquid, rotary power is created which is usually used to drive electrical power generating means but which could be used for other work. The discharge stream from the turbine expander is cooled, and it is either condensed by vaporizing LNG or returned to the insulated vessel where it condenses by melting solid carbon dioxide therein. Alternatively, the entire stream of $CO_2$ vapor could be returned to the insulated vessel while a separate vapor stream is removed from the top of the vessel for condensing against the LNG. During off-peak periods, or whenever there is more $CO_2$ being condensed by LNG to be vaporized than there is $CO_2$ vapor from the Rankine cycle to be condensed, $CO_2$ solid is formed in the insulated vessel so as to "recharge" its refrigeration capacity.

A particular advantage of the invention lies in its being able to very efficiently utilize the cold temperature of LNG in creating solid $CO_2$ at a temperature of about −70° F. The system can be arranged so that the bulk of the refrigeration is provided by evaporating LNG at a temperature which is not much colder than is required by the $CO_2$ power cycle. By this method, the best use of the LNG refrigeration potential is made. The natural gas expander pressure selected is a function of the desired balance between continuous power generation (the natural gas power cycle) and peak power (the $CO_2$ power cycle), as explained in detail hereinafter.

DETAILED DESCRIPTION OF PREFERRED EMBODIMENTS

Figure 1:
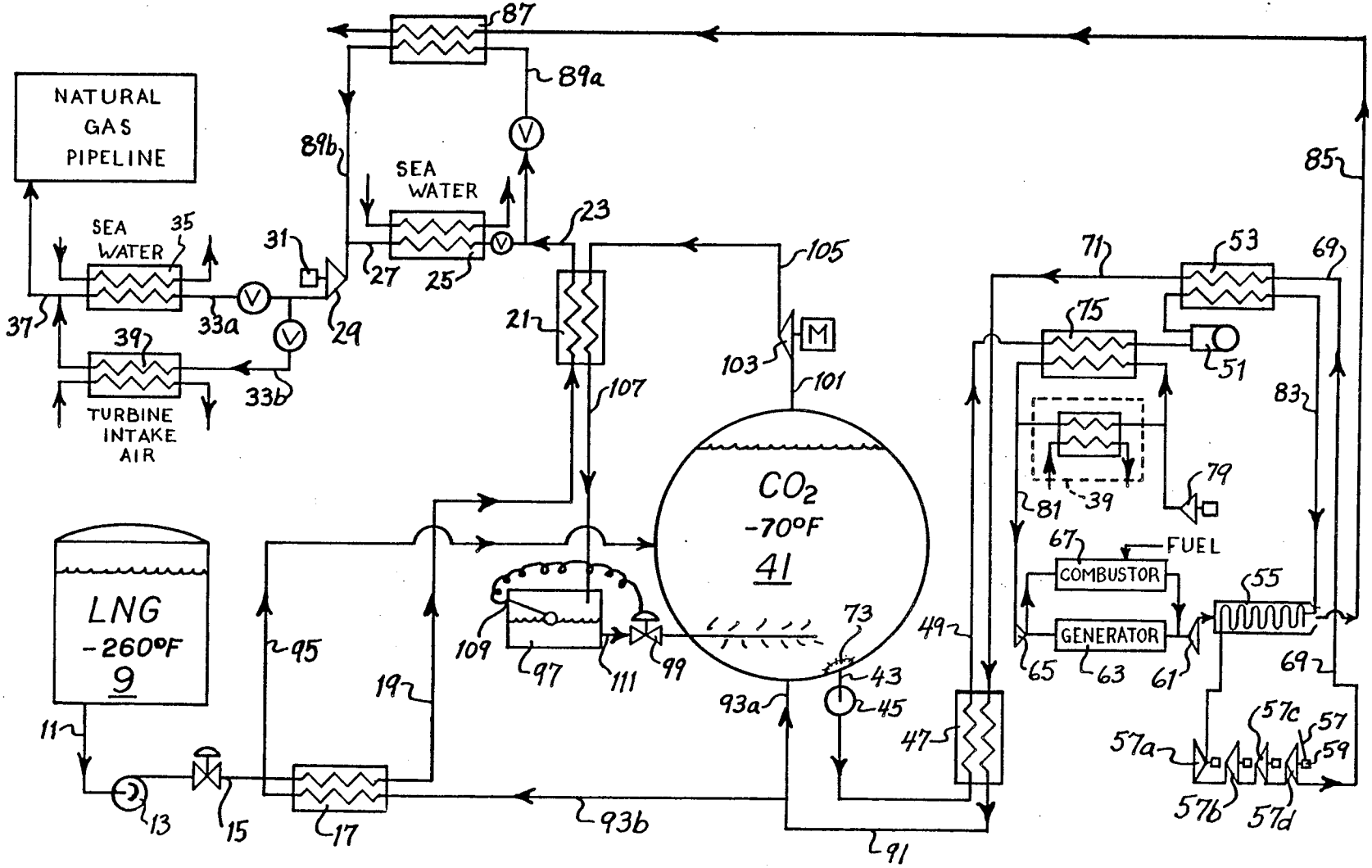
FIG. 1 is a diagrammatic illustration of an electrical power generation system using LNG both as a source of refrigeration and as a working fluid and using carbon dioxide to store refrigeration until periods of peak power demand and then as a working fluid, which installation incorporates various features of the invention.

FIG. 1 shows an illustrative system which efficiently generates electrical power from LNG, taking advantage of its refrigeration potential in combination with the unique characteristics of carbon dioxide at its triple point as an energy storage medium, as well as its thermodynamic properties as a working fluid in an overall power cycle. Refrigeration storage at the triple point of $CO_2$ allows the overall system to accept refrigeration whenever LNG is being vaporized, including during off-peak periods with respect to electrical power demand. Advantage is then taken of this reservoir during periods of peak power demand to economically generate additional power. A combustion turbine is preferably sized to provide an appropriate amount of the anticipated peak electrical power capacity, and its cost is more than justified by the overall efficiency resulting from the use of $CO_2$. Moreover, should other inexpensive heat sources be available, advantage may be profitably taken of them.

Illustrated in FIG. 1 is a system which includes a tank 9 designed to store LNG at a temperature of about −260° F and atmospheric pressure. The LNG is withdrawn through a line 11 to the suction side of a pump 13 which increases the pressure to at least about 400 psia, more preferably to 500–600 psia and most preferably to at least about 800 psia. At pressures between about 400 psia and about 700 psia, LNG vaporizes between about −145° F and about −110° F. At supercritical pressures between about 700 psia and about 900 psia, LNG exhibits its largest isobaric enthalpy change between about −110° F and about −100° F. The high pressure LNG is directed through line 15 to a heat exchanger 17 where it flows in heat exchange relationship with $CO_2$ vapor that is returning from a $CO_2$ power cycle, as explained in detail hereinafter. From the heat exchanger 17, the LNG flows through line 19 leading to a heat exchanger 21, where it also flows in heat exchange relationship with $CO_2$ vapor being withdrawn from a $CO_2$ storage vessel, as explained in detail hereinafter. As a result of the heat from the condensing $CO_2$ vapor which was absorbed by the LNG in the heat exchangers 17 and 21, it is preferably entirely in the vapor phase when it exits the heat exchanger 21. The high pressure natural gas then flows through line 23 leading to a heat exchanger 25 wherein it absorbs sensible heat from a suitable source of heat, such as sea water or ambient air. The warmed high pressure natural gas exits from the heat exchanger 25 through a line 27 leading to an expander 29, usually of a standard turbine design which creates rotary power that is employed to drive an electrical generator 31 mechanically connected thereto. In the expander 29, the pressure of the natural gas is dropped to about the desired pipeline pressure, and as a result of this expansion, its temperature significantly drops; thus, the temperature of the natural gas exiting the expander is below the desired pipeline temperature. Before delivering this natural gas to the pipeline, it should be warmed to about the appropriate pipeline condition, usually to at least about 40° F, and in the illustrated embodiment, the line exiting from the expander is split into lines **33*a* and 33*b*. Line 33*a* leads to a heat exchanger 35 wherein the natural gas is warmed by absorbing heat from sea water before reaching a line 37 leading to the natural gas pipeline. Alternatively, the natural gas flowing through the line 33*b* enters a heat exchanger 39 where it absorbs heat from the intake air to combustion turbine, as explained hereinafter, before it enters the line 37** leading to the natural gas pipeline.

The cooperating $CO_2$ power cycle half of the overall combined system includes a pressure vessel in the form of a sphere 41 that is appropriately insulated and designed to store carbon dioxide at its triple point of about −70° F and about 75 psia, at which it exists in the form of solid, liquid and vapor. Liquid $CO_2$ is preferably withdrawn from a lower location in the sphere through a line 43 leading to a first pump 45 which initially raises the pressure to about 800 psia. This higher pressure liquid is directed through a heat exchanger 47, through a line 49 and then through a heat exchanger 75 as it travels to a high pressure pump 51 which raises the liquid pressure to at least about 1000 psia, preferably to at least about 2000 psia and more preferably to about 4000 psia or above. This high pressure liquid $CO_2$ passes through a heat exchanger 53 where its temperature is raised to between about 100° and about 250° F and then through a main heat exchanger 55 where it is preferably completely vaporized, its temperature being raised to preferably at least about 500° F, more preferably at least about 1000° F., and most preferably above about 1600° F. The hot, high pressure carbon dioxide stream is then directed to the inlet of an expander 57, which may include a plurality of expansion stages. The expander is mechanically linked to an electrical power generation unit 59 which may be in the form of a single generator or a plurality of generators. For example, each expansion stage 57*a*–57*d* may be suitably connected to a single electrical generator.

In the illustrated embodiment in FIG. 1, the heat source for the main heat exchanger 55 is the hot exhaust gas from a combustion turbine unit 61 which drives an electrical generator 63 and a compressor 65. Compressed air from the compressor 65 is fed to a combustor 67 along with a liquid or gaseous fuel to create the hot high pressure gas that drives the gas turbine 61.

The hot $CO_2$ vapor discharge from the expander 57 is routed through a line 69 which leads to the heat exchanger 53 where it passes in heat exchange relationship with the high pressure liquid carbon dioxide, giving up some of its heat thereto, and then through a line 71 which leads through the heat exchanger 47 to a line 91 which is branched. One branch 93*a* leads to a lower entrance to the sphere 41 where the returning vapor is condensed by melting solid $CO_2$ in the slush stored therein; whereas the other branch 93*b* carries the $CO_2$ vapor to heat exchanger 17 where it is condensed by heat exchange with evaporating LNG. The temperature of the returning vapor is preferably lowered to at least about −50° F in the heat exchanger 47.

During periods of peak demand, substantially all of the electrical power produced by the main generator 63 and by the generation unit 59 connected to the expander 57 is available to be fed into the electrical power grid of an electrical utility. During periods of off-peak electrical power demand, the $CO_2$-slush-containing sphere 41 is "recharged" as LNG continues to be vaporized to fulfill pipeline requirements.

The insulated sphere 41 could be scaled to hold an amount of $CO_2$ slush adequate to allow it to satisfactorily vaporize LNG requirements on a daily basis, and possibly including weekends. Alternatively, the sphere could be scaled to provide the daily or weekly storage needs of the $CO_2$ power cycle, while the LNG vaporization system is scaled to suit the corresponding recharge requirements of the sphere. The $CO_2$ power cycle would preferably be operated during the peak demand hours, as determined by the local electrical utilities, during which time the slush content of the sphere decreases as electrical power is generated. In any event, it is likely the storage vessel 41 might be a sphere about 50 to 100 feet or more in diameter, constructed of a suitable material, such as 9% nickel steel or stainless steel, that will have adequate structural strength at $CO_2$ triple point temperature. Likewise, its insulation should be suitable for maintaining acceptable heat leakage therethrough from ambient to about −70° F, for example, about 6 inches of commercially available polyurethane foam insulation might be used.

The storage vessel 41 should be designed to reasonably withstand an internal pressure of about 100 psia, and a suitable pressure release valve (not shown) is provided so as to vent $CO_2$ vapor at such a design pressure and thus hold the contents of the vessel at about −58° F until such time that whatever deficiency, which allowed the rise in pressure above the triple point, can be corrected. Auxiliary refrigeration equipment, as well known in the art, can be optionally provided for back-up; however, this should not likely be necessary. Although a sphere should be the preferable design for the storage vessel, other types of suitable storage vessels might be used; for example, several cylindrical vessels, oriented horizontally, such as are commonly used at plants requiring relatively large amounts of liquid nitrogen or liquid carbon dioxide, although presenting relatively larger amounts of surface area, might be used if similarly insulated to maintain triple point temperature therewithin.

In a particularly preferred version of the $CO_2$ power cycle portion of the overall system, liquid $CO_2$ from the storage vessel 41 is withdrawn from a lower location in the sphere through line 43, the entrance to which line is preferably through a screen 73 disposed interior of the storage vessel which allows the flow of only liquid $CO_2$ and prevents solid $CO_2$ from entering the line 43. In order to assure that the liquid $CO_2$ remains in liquid form as it flows through the heat exchangers 47 and 75, the centrifugal pump 45 raises the pressure to about 800 psia, keeping the line 49 leading to the high pressure pump 51 full of liquid $CO_2$ at all times. The cold, approximately −70° F liquid $CO_2$ flowing through the heat exchanger 47 takes up heat from the returning $CO_2$ vapor stream, as explained hereinafter in more detail.

In an overall system including a combustion turbine 61, it may be beneficial to cool the inlet air to the compressor section 65 of the turbine, especially during the summer months when ambient air temperature and peak use of electrical power are at their highest. Illustrated are a pair of heat exchangers arranged in parallel which are provided for this purpose, the use of either or both of which cools the temperature of ambient air from about 95° F to about 40° F at the desired ambient air flow rate. The heat exchanger 39 is that previously described which supplies heat to the expanded natural gas entering through the line 33*b* and is also shown in dotted outline adjacent the combustor section 67 of the gas turbine. A companion heat exchanger 75 is located in countercurrent flow with the liquid $CO_2$ in the line 49 leading to the high pressure pump. Ambient air is supplied by an electrically-powered blower 79 to either or both of the heat exchangers 39 and 75 and thereafter travels through a duct 81 leading to the compressor 65.

The electrical power output of the turbine 61 can be significantly increased by so cooling the inlet air.

The slightly warmed liquid $CO_2$ stream from the heat exchanger 75 is directed to the high pressure pump 51 which raises the pressure of the liquid usually to between 3000 and 5000 psia; preferably a pressure of at least about 4000 psia is achieved. The temperature of the liquid $CO_2$ is raised about 20° F in the high pressure pump and may exit therefrom at a temperature of about 70° F.

This high pressure stream then passes through the heat exchanger 53 where it flows in countercurrent heat exchange relationship with expanded, hot $CO_2$ vapor returning toward the sphere 41. It is advantageous to use this heat exchanger to raise the temperature of the stream to at least about 150° F, cooling the returning $CO_2$ vapor stream as explained hereinafter.

The high pressure stream then flows through a line 83 leading to the main $CO_2$ heat exchanger 55, which in the illustrated embodiment is heated by the exhaust from the combustion turbine unit 61. This arrangement is a particularly cost-effective way of heating the high pressure carbon dioxide because the gas turbine exhaust provides useful heat in a range typically between about 900° F and about 1000° F. Countercurrent flow of the high pressure stream through the main heat exchanger 55 allows its temperature to rise to within about 50° F. of the turbine exhaust temperature, e.g. to about 940° F. The heat exchanger 55 might have stabilized stainless steel, fin-carrying tubes through which the incoming high pressure $CO_2$ stream flows in heat exchange relationship with the turbine exhaust gases on the shell side thereof.

The temperature of the hot exhaust gas stream from the turbine 61 may drop to about 250° F at the exit from the heat exchanger 55. Instead of being discharged as waste heat, this hot gas can be directed through a duct 85 leading to a heat exchanger 87 that is located in parallel to the heat exchanger 25 that is used to warm the high pressure natural gas. As shown in FIG. 1, a branch line **89*a* can be connected to a tee between the heat exchanger 21 and the heat exchanger 25 in the line 23. Accordingly, when the combustion turbine is operating, a portion or all of the flow of natural gas can be diverted through the line 89*a* so as to be warmed in the heat exchanger 87, which could be arranged for either concurrent or countercurrent flow, exiting through the line 89*b* which connects via a tee to the line 27 leading to the natural gas expander. Utilization of such a heat exchanger 87** can cut down on the energy expended pumping sea water and can increase efficiency.

The high pressure $CO_2$ stream exiting the main heat exchanger 55 is directed to the turbine-expander 57, which in the illustrated embodiment is a series of four stages, each being a radial inflow turbine expansion stage. Energy output from a high pressure, high temperature stream is increased by expanding it in stages through turbine-expanders individually designed for such pressure characteristics. The individual stages **57*a*, *b*, *c* and *d* are shown as being mechanically linked to separate generator units 59** although all may be suitably mechanically interconnected to a single electrical power generator. A multistage, axial flow expander can also be used.

The $CO_2$ stream leaving the composite turbine-expander has preferably been expanded to a dry vapor; however, the vapor might contain entrained liquid carbon dioxide not exceeding about 10 weight percent of the $CO_2$. The temperature and pressure (and liquid weight percent, if any) of the exit stream are based upon the overall system design. The pressure of the expanded $CO_2$ stream may be as low as about 80 psia to about 150 psia and have a temperature of about 300° F. The effectiveness of the turbine-expander 57 is a function of the ratio of the inlet pressure to outlet pressure, and accordingly the lower the outlet pressure, the greater will be its effectiveness.

If the expanded $CO_2$ stream in the line 69 is at a temperature of about 300° F, its temperature may be dropped, for example, to about 95° F in the recuperative heat exchanger 53. The exit stream from the heat exchanger 53 flows through the line 71 to the heat exchanger 47 which also serves as a recuperator wherein the returning $CO_2$ passes in heat exchange relationship with the cold, triple point liquid leaving the storage vessel 41. The heat exchange surface is preferably such that, with countercurrent flow, the temperature of the returning $CO_2$ drops to at least about −30° F. The returning vapor exits the heat exchanger 47 through the line 91 which is branched, and some or all of the vapor at a pressure of about 125 psia may be bubbled into the sphere 41. The vapor flowing through the branch **93*a* bubbles into the bottom of the sphere 41; the vapor flowing through the branch line 93*b* enters the heat exchanger 17 and where it is condensed while supplying heat to the high pressure LNG. The liquid $CO_2$ condensate from the heat exchanger 17 is at a similar pressure and flows through the line 95 directly into the storage sphere 41**.

The main sphere 41, which contains $CO_2$ at the triple point in the operating system, is appropriately first filled with liquid $CO_2$, and a separate high pressure liquid $CO_2$ supply tank (not shown), such as a conventional liquid $CO_2$ storage vessel designed to maintain liquid $CO_2$ at a temperature of about 0° F and a pressure of about 300 psia, as is well known in the art, may be provided on the site. In general, removal of $CO_2$ vapor from the ullage or uppermost region of the sphere 41 through a line 101 causes evaporation of liquid $CO_2$ at the upper surface of the liquid in the sphere 41 and the lowering of the temperature, which temperature drop continues until the body of liquid $CO_2$ in the vessel reaches the triple point of about 75 psia and −70° F. At this point, crystals of solid $CO_2$ form at the vapor-liquid interface and begin to slowly grow in size, with about 1.8 pounds of solid $CO_2$ being formed for every pound of liquid $CO_2$ that is vaporized. Because solid $CO_2$ has a greater density than liquid $CO_2$, the crystals begin to sink to the bottom of the vessel, forming what is referred to as $CO_2$ slush, a mixture of solid and liquid $CO_2$. It is considered feasible to achieve and maintain within such a sphere about 80% to about 90% of the total weight of the $CO_2$ therein in the form of solid $CO_2$.

Under normal operating conditions, vapor flows through the line 101 to the inlet of a $CO_2$ compressor 103 driven by a suitable electric motor. Preferably, a very good oil separator is provided at the outlet of the compressor 103 to prevent any buildup of oil in the sphere 41. The discharge pressure from the compressor is preferably between about 120 and about 160 psia at which pressures $CO_2$ condenses between about −50° F and about −35° F.

The discharge stream from the compressor flows through a line 105 to the heat exchanger 21 where it is condensed to liquid $CO_2$ for return to the sphere through a line 107. In the heat exchanger, the condensing $CO_2$ gives up its latent heat to the evaporating LNG which is flowing on the other side of the extended heat-transfer surface, such as a tube-and-shell-heat-exchanger with the LNG being on the shell side thereof. The match between the condensing $CO_2$ vapor and the evaporating LNG is excellent and allows for the good efficiency of the overall system, by taking maximum advantage of the latent heats of both of these fluids. More specifically, carbon dioxide vapor at a pressure of about 140 psia condenses at a temperature of about −42° F. and supplies a large quantity of heat at that temperature to one side of heat transfer surface. Simultaneously, LNG at a pressure of about 627 psia vaporizes at a temperature of about −120° F and thus provides a large heat sink at this temperature. As a result, the temperature differential across the heat transfer surface is excellent for obtaining high efficiency of the overall operation.

The condensed liquid $CO_2$ travels through the line 107 leading to a holding or surge tank 97 which preferably contains a float-valve control 109 that assures that a line 111 connecting the tank 97 and the sphere 41 remains substantially filled with liquid $CO_2$ by causing a valve 99 to close if the liquid level in surge tank drops below a predetermined level. If the overall LNG vaporization system is not operating for some reason, in order to maintain the desired triple point $CO_2$ reservoir, $CO_2$ vapor can be removed through the line 101 by the compressor and supplied to a relatively conventional mechanical refrigeration system (not shown) to condense it to liquid $CO_2$ for ultimate return to the storage vessel 41 through the holding tank 97 and pressure-regulator valve 99.

As previously indicated, the overall system is most efficiently operated by sizing the storage vessel 41 so that it can accommodate all of the solid $CO_2$ formed during the periods of off-peak electrical power demand when natural gas is being supplied to the pipeline. Thereafter, during peak demand periods, maximum electrical power generation is achieved at high efficiency when power generation is most critical. During periods of peak power demand, there will be a greater amount of $CO_2$ vapor flowing through the line 91 from the heat exchanger 47 than can be condensed by the LNG being evaporated for supply to the pipeline. Accordingly, at least some of the returning $CO_2$ vapor will flow through the line **93*a* and bubble into the sphere 41 where it is condensed by melting the solid $CO_2$ in the slush portion of the sphere. In any event, the two heat exchangers 17 and 21 are appropriately sized so either (or both together) can accommodate the vaporization of LNG during periods of maximum pipeline demand, and a suitable control system is provided (such as that shown in FIG. 2**) to efficiently condense all the returning $CO_2$ vapor during periods of peak electrical power generation.

Base load operation of the plant might be sized to be about 5 MW, i.e. when the average amount of LNG is being supplied to the pipeline and the $CO_2$ Power Cycle is not being operated. In general, the power that will be generated from the vaporizing LNG varies inversely with the supply pressure that is required for the pipeline to which the natural gas is being delivered, with the desired delivery temperature of the natural gas being about 40° F. In general, if the pipeline pressure is about 150 psia, it is possible to generate about 33 kilowatt hours of electricity for each metric ton of LNG that is vaporized, in which case the pump 13 would raise the LNG pressure to about 400 psia. If the pipeline pressure is 300 psia, the pump pressure is increased to about 600 psia and the rate of power generation drops to about 22 kilowatt hours per metric ton of LNG being vaporized. At a pipeline pressure of about 500 psia and a pump pressure of about 800 psia, the output is about 15 KWh/ton LNG.

During periods of peak power output (possibly 6 hours per day) when the combustion turbine and the $CO_2$ Power Cycle are in operation, so that the installation is running at essentially full capacity, capacity might be about 100 MW. The output from the $CO_2$ Power Cycle is also dependent upon the characteristics of the LNG vaporization operation; over any defined period of time, for example one week, it is desired that the total amount of $CO_2$ vapor which is condensed by the vaporization of LNG should be about equal to the total amount of $CO_2$ being vaporized over the same time period by the $CO_2$ power cycle. Accordingly, when operating at a pipeline pressure of about 150 psia, it should be possible to generate about 140 KWh/ton LNG being vaporized over that time period. At a pipeline pressure of about 300 psia, the figure drops to about 130, and at a pipeline pressure of about 500 psia, the figure drops to about 109 KWh/ton LNG.

Figure 2:
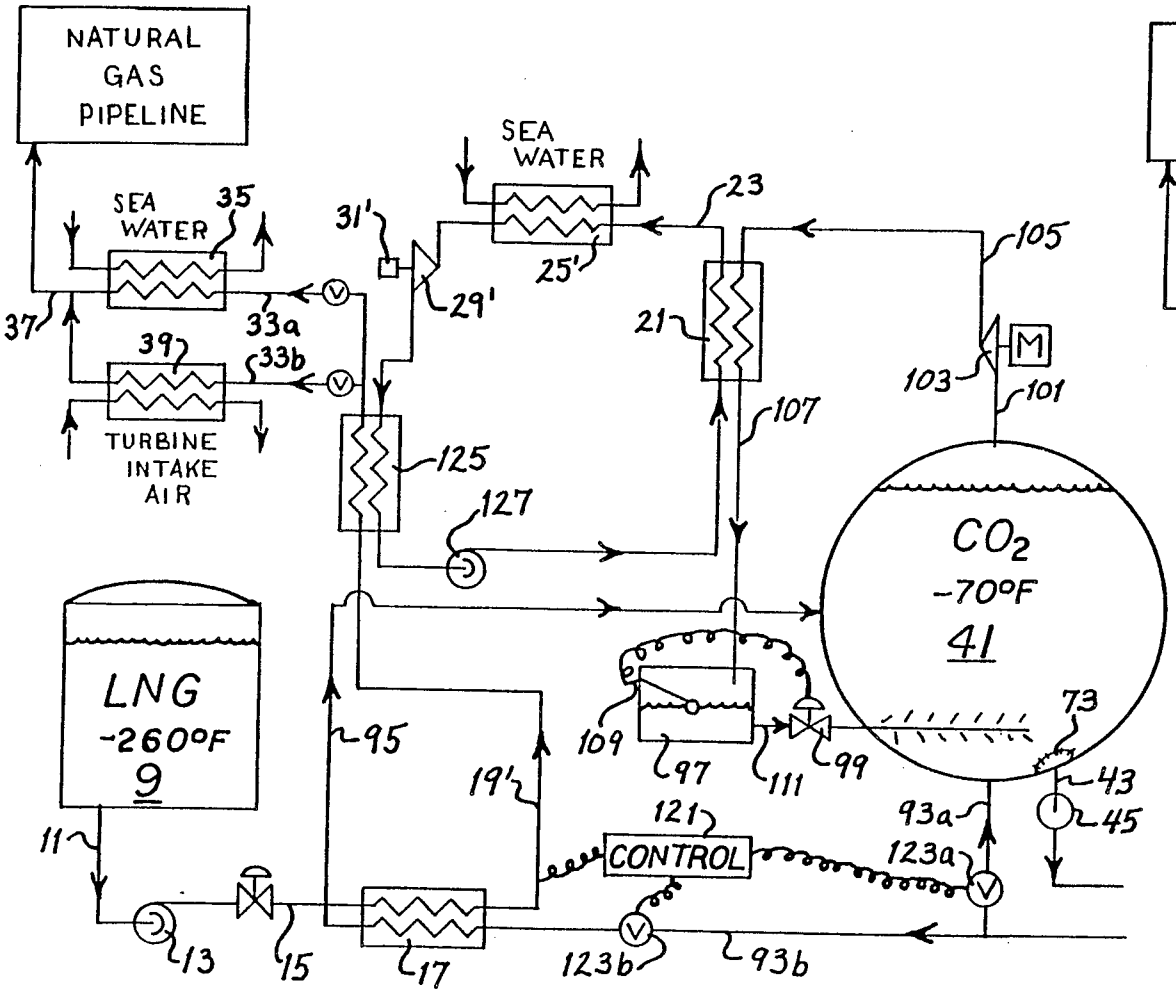

Illustrated in FIG. 2 is an alternative embodiment of the invention wherein, instead of directly expanding the natural gas, an intermediate working fluid is employed during baseload operation of the plant. A suitable working fluid is chosen having characteristics well matched to natural gas (which is primarily methane); ethane is the preferred candidate for such a working fluid although others known in this art might instead be used. In this embodiment, LNG is pumped to just above the pipeline distribution pressure, and some heat is added to the LNG in the heat exchanger 17 by condensing a fraction of the returning $CO_2$ vapor when the $CO_2$ Power Cycle is operating. Of course, when the $CO_2$ Power Cycle is not in operation, then no heat is added at the heat exchanger 17. Control of the amount of $CO_2$ vapor supplied to the heat exchanger 17 is accomplished by means of a control system 121 which monitors the temperature of the fluid stream leaving the LNG side of the heat exchanger 17 in the line 19' and controls valve **123*a* in line 93*a* and valve 123*b* in line 93*b* so as to supply an appropriate amount of $CO_2$ vapor to the heat exchanger 17**.

The LNG flows through the line 19' to a heat exchanger 125 where it is vaporized against the condensing intermediate working fluid, e.g. ethane. The natural gas exiting from the heat exchanger 125 flows through the lines **33*a* and 33*b* to the heat exchangers 35 and 39, respectively, in which it is heated to a temperature, e.g. 40° F., appropriate for supply to the natural gas pipeline through line 37. More particularly, when such an intermediate working fluid is employed, the pump 13 may raise the pressure of the LNG to only slightly above the desired pipeline pressure, at which pressure it is optionally warmed against $CO_2$ vapor before being vaporized by condensing the intermediate working fluid. If it is vaporized at a pressure substantially above the normal pipeline pressure, a valve (not shown) is provided downstream of the heat exchanger 125 through which it is expanded to the pipeline pressure before being warmed in the heat exchangers 35 and 39**.

The intermediate working fluid, e.g. ethane, after being condensed in the heat exchanger 125, is then pumped to a pressure between about 30 psia and about 60 psia by a pump 127 before being supplied to the heat exchanger 21. The liquid ethane is vaporized in the heat exchanger 21, with the latent heat of vaporization being provided by the stream of $CO_2$ vapor exiting the compressor 103 via the line 105, which is condensed to liquid $CO_2$ on the other side of the heat transfer surface. The vaporized ethane, which may be at a temperature of about −80° F., is warmed in the heat exchanger 25' against an ambient fluid, such as sea water, and then delivered to the expander 29' where it generates rotary power that is used to drive an electrical generator 31'. The expanded ethane vapor then returns to the heat exchanger 125 where it is condensed for another pass through the intermediate working fluid power cycle.

Figure 3:
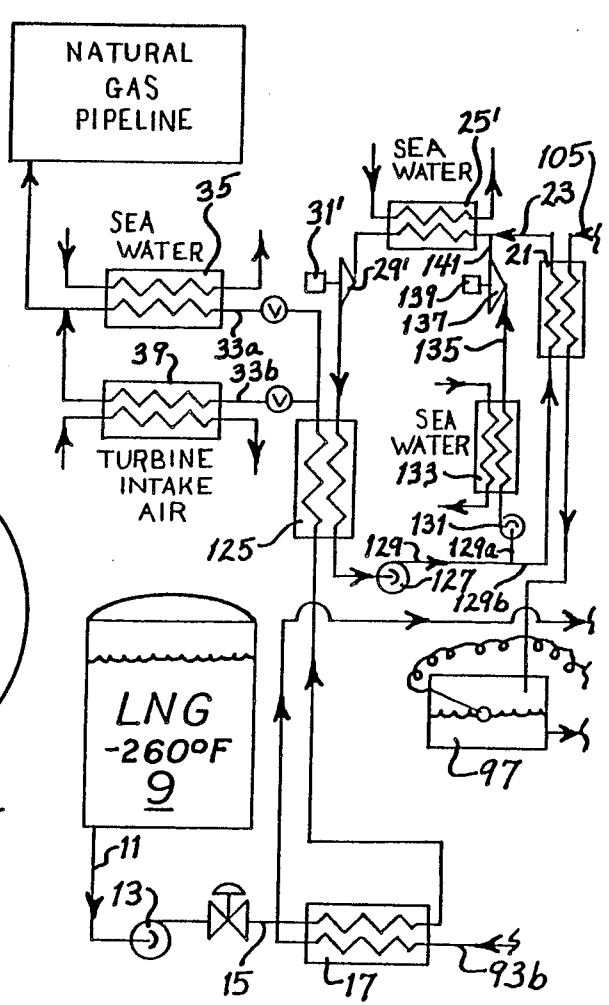
FIGS. 2 and 3 illustrate alternative embodiments to that shown in FIG. 1.

A further alternative embodiment is shown in FIG. 3 wherein there is a variation in the intermediate working fluid power cycle from that depicted in FIG. 2, whereas the LNG vaporization circuit operates as explained with respect to the FIG. 2 embodiment. After the condensed intermediate working fluid exiting the heat exchanger 125 is increased in pressure by the pump 127, it flows through a line 129 which is branched. Branch **129*a* leads to a pump 131 whereas branch 129*b* leads to the heat exchanger 21 wherein the $CO_2$ vapor from the compressor 103 is being condensed. The pump 131 increases the pressure of a portion of the ethane to about 300 psia, and this higher pressure ethane is supplied to a heat exchanger 133 wherein it is warmed to a temperature of about 40° F. by heat exchange against an ambient fluid, such as sea water. The heated, higher pressure ethane flows through a line 135 to an expander 137 wherein it is expanded to the pressure in the line 129*b*, driving an electrical power generator 139. The expanded vapor stream flows through a line 141 which joins the line 23 leading to the heat exchanger 25' wherein the combined streams are heated to a temperature of about 40° F. by exchange against a suitable heat source, e.g. an ambient fluid, such as sea water, before being supplied to the expander 29'. As in the FIG. 2 embodiment, the warmed high pressure ethane is expanded, creating electrical power by driving the generator 31' and is then returned to the heat exchanger 125** where it is condensed against the vaporizing LNG. This two-stage expansion of a portion of the intermediate working fluid increases the baseload power generation, i.e. that which is obtained from the vaporization of an average amount of LNG per hour.

Although the illustrated embodiments disclose the preferred utilization of hot exhaust from a combustion turbine to provide the heat for vaporizing the high pressure $CO_2$ stream, other heating arrangements are possible. For example, the use of solar energy to heat a high pressure $CO_2$ stream, using the emerging technology that is developing more efficient solar heaters in the United States, is a concept that is particularly feasible because the period of peak power usage usually coincides with the hottest time of the day.

Although the invention has been described with regard to its preferred embodiments, it should be understood that various changes and modifications as would be obvious to one having the ordinary skill in this art may be made without departing from the scope of the invention which is defined by the claims appended hereto. For example, it should be apparent to those skilled in the art that, alternatively in each disclosed embodiment, two or more stages of natural gas expansion can be employed, with or without intermediate reheat between stages using ambient or other heat sources. Moreover, the recharge of triple-point $CO_2$ storage can be accomplished in other suitable alternative manners than the withdrawal of $CO_2$ vapor from storage, its condensation and the return of $CO_2$ liquid thereto. Specific examples include: locating the evaporator coil or heat exchanger wherein the LNG is being vaporized physically within the sphere 41 so as to condense and/or solidify $CO_2$ in situ within the sphere; and employing an external heat exchanger wherein the LNG is vaporized to which liquid $CO_2$ (instead of $CO_2$ vapor) is pumped while controlling the rate of $CO_2$ liquid flow through such heat exchanger so that some $CO_2$ is solidified, thereby producing a pumpable liquid-solid $CO_2$ slurry which flows back into the sphere 41. This application discusses $CO_2$ throughout as the preferred cryogen; however, another cryogen having similar characteristics, such as a favorable triple point to permit storage in the described manner, would be considered equivalent.

Particular features of the invention are emphasized in the claims which follow.

What is claimed is:

1. A method for generating power from LNG and storing energy , which method comprises providing a source of LNG at a temperature of about −250° F. or lower, increasing the pressure of said LNG to at least about 400 psia, creating a reservoir of carbon dioxide liquid at about the triple point thereof which reservoir contains a substantial amount of solid carbon dioxide, vaporizing said LNG to natural gas by removing heat from $CO_2$ at about the triple point temperature, heating said high pressure natural gas, expanding said heated natural gas to create rotary power, and employing the carbon dioxide in said reservoir in a useful manner which results in the creation of $CO_2$ vapor that is subsequently reliquefied.

2. A method according to claim 1 wherein carbon dioxide vapor is withdrawn from said reservoir, resulting in the formation of solid $CO_2$, and caused to flow in heat exchange relationship with said increased-pressure LNG to vaporize said LNG to natural gas while condensing said vapor to liquid $CO_2$, and wherein said condensed liquid carbon dioxide is transferred to said reservoir.

3. A method according to claim 1 wherein said high pressure natural gas is heated using an ambient source of heat.

4. A method according to claim 1 wherein said expanded natural gas is heated using an ambient source of heat to about desired pipeline temperature.

5. A method according to claim 1 which includes the steps of withdrawing liquid carbon dioxide from said reservoir and very substantially increasing the pressure of said withdrawn liquid, heating said increased pressure carbon dioxide, expanding said heated carbon dioxide to dry vapor or to vapor containing some entrained liquid to create additional rotary power, and directing the discharge stream from said carbon dioxide expanding step to said reservoir and/or to said LNG vaporizing step.

6. A method according to claim 5 wherein electrical power is generated using said rotary power and said additional rotary power.

7. A method according to claim 5 wherein said increased pressure $CO_2$ is heated by the exit stream from a fuel-fired turbine and, prior to being expanded, is at a temperature above its critical temperature.

8. A method for generating power from LNG and storing energy and then using such stored energy to generate additional power, which method comprises the following steps, providing a source of LNG at a temperature of about −250° F. or lower, increasing the pressure of said LNG to at least about 50 psia, vaporizing said increased pressure LNG to natural gas by passing it in heat exchange relationship with a working fluid vapor which is condensed, increasing the pressure of said liquefied working fluid, heating said increased pressure working fluid to vaporize it, expanding said heated working fluid vapor to create rotary power, creating a reservoir of carbon dioxide at about the triple point thereof, which reservoir contains a substantial percentage of solid carbon dioxide, withdrawing a stream of liquid carbon dioxide from said reservoir and very substantially increasing the pressure of said stream of withdrawn liquid, heating said increased pressure carbon dioxide stream above its critical temperature, expanding said heated carbon dioxide stream to dry vapor or to vapor containing some entrained liquid to create additional rotary power, and returning at least a portion of the expanded $CO_2$ to said reservoir where carbon dioxide vapor is condensed by melting solid carbon dioxide therein and directing any remainder of said expanded $CO_2$ vapor to said working fluid heating step where it is condensed.

9. A method in accordance with claim 8 wherein the pressure of said withdrawn carbon dioxide is increased to at least about 1000 psia, wherein said increased pressure carbon dioxide is heated to at least about 500° F. prior to its said expanding step and wherein said lower pressure discharge stream from said expanding step is cooled to about −50° F. or lower before being returned to said reservoir.

10. A method in accordance with claim 9 wherein said increased pressure liquefied fluid is split into two streams, one of said streams is further increased substantially in pressure, both streams are then heated to vaporize said working fluid, both streams are then expanded to create rotary power and said expanded streams are combined and condensed while vaporizing said LNG.

11. A method for generating power from LNG and storing energy and then using such stored energy to generate additional power, which method comprises the following steps, providing a source of LNG at a temperature of about −250° F. or lower, increasing the pressure of said LNG to between about 400 psia and about 900 psia, creating a reservoir of carbon dioxide at about the triple point thereof, which reservoir contains a substantial percentage of solid carbon dioxide, withdrawing a stream of liquid carbon dioxide from said reservoir and very substantially increasing the pressure of said stream of withdrawn liquid, heating said increased pressure carbon dioxide stream above its critical temperature, expanding said heated carbon dioxide stream to dry vapor or to vapor containing some entrained liquid, returning at least a portion of the expanded $CO_2$ to said reservoir where carbon dioxide vapor is condensed by melting solid carbon dioxide therein, vaporizing said high pressure LNG to natural gas by condensing $CO_2$ vapor, heating said high pressure natural gas, expanding said heated natural gas, and creating rotary power from said expansion steps.

12. A system for generating power from LNG and storing energy which is thereafter used to generate additional power, which system comprises a source of LNG, means for increasing the pressure of said LNG to at least about 400 psia, insulated vessel means for storing liquid carbon dioxide at its triple point, means for vaporizing said high pressure LNG by removing heat from carbon dioxide at about its triple point to create a reservoir of carbon dioxide containing a substantial amount of solid carbon dioxide at about the triple point thereof in said vessel means, means for heating said vaporized high pressure natural gas, means for expanding said heated natural gas to create rotary power, and means for employing the carbon dioxide in said reservoir in a useful manner which creates $CO_2$ vapor.

13. A system according to claim 12 wherein said means for heating said natural gas comprises a heat exchanger to which an ambient temperature fluid is supplied.

14. A system according to claim 12 wherein an additional heat exchanger is provided to which an ambient temperature fluid is supplied for heating said expanded natural gas to about desired pipeline temperature.

15. A system according to claim 12 wherein said LNG pressure-increasing means is a high pressure pump that increases LNG pressure to at least about 400 psia.

16. A system according to claim 12 wherein there is provided means for withdrawing liquid carbon dioxide from said vessel means and very substantially increasing the pressure of said withdrawn liquid, further means for heating said higher pressure carbon dioxide, means connected to an outlet from said further heating means for expanding said heated carbon dioxide to dry vapor or to vapor containing some entrained liquid to create additional rotary power, and means for returning the discharge stream from said expanding means to said vessel means where carbon dioxide vapor is condensed by melting solid carbon dioxide therein.

17. A system according to claim 16 wherein heat exchange means is connected to said LNG pressure-increasing means, means is provided for supplying carbon dioxide vapor from said reservoir to said heat exchange means to vaporize said LNG therein to natural gas while condensing said vapor to liquid $CO_2$, and means is provided for transferring said condensed liquid carbon dioxide to said reservoir.

18. A system according to claim 16 wherein electrical power generating means is connected to said means for creating rotary power and to said means for creating additional rotary power.

19. A system according to claim 16 wherein a fuel-fired combustion turbine is provided and wherein means is provided directing the hot exit stream from said turbine to said further means for heating said higher pressure $CO_2$.

* * * * *